US005165200A

United States Patent [19]

Oga

[11] Patent Number: 5,165,200

[45] Date of Patent: Nov. 24, 1992

[54] PARKING SPACE BARRIER

[76] Inventor: Sako Oga, 67-40 C 193 La., Fresh Meadows, New York, N.Y. 11365

[21] Appl. No.: 857,967

[22] Filed: Mar. 26, 1992

[51] Int. Cl.[5] ..... E05F 13/00

[52] U.S. Cl. ..... 49/49; 49/9

[58] Field of Search ..... 49/49, 35, 9

[56] References Cited

U.S. PATENT DOCUMENTS

| | | | |
|---|---|---|---|
| 2,356,559 | 8/1944 | Banschbach | 49/49 |
| 3,849,936 | 11/1974 | Geraci | 49/49 X |
| 3,913,264 | 10/1975 | Kohen | 49/49 |
| 4,879,554 | 11/1989 | Diaz-Silveira | 49/49 X |

*Primary Examiner*—Philip C. Kannan
*Attorney, Agent, or Firm*—Robert W. J. Usher

[57] ABSTRACT

A parking space barrier comprises a stationary base for anchoring to the ground of a parking space and a moveable pylon attached to the base member by an extensible cable. The pylon comprises a cushioned peripheral portion upstanding from a carriage containing a spring motor attached to one end of the cable. A wirelessly operated lock remotely controlled by the car driver secures the carriage to the base adjacent the entrance to the parking space. A car entering the parking space engages the cushioned peripheral portion and pushes the pylon before it across the parking space to a vehicle admitting position, the cable extending under the car and winding the spring motor so that the pylon will be drawn back by the spring motor and cable with the car when reversing out of the parking space. A manually operable arresting device is provided to maintain the pylon in the vehicle admitting position remote from the base member, if required. An indicator showing the condition of the locking device is mounted at the top of the pylon and directly linked to the locking mechanism to show the locking position.

14 Claims, 8 Drawing Sheets

PARKING SPACE BARRIER

FIELD OF THE INVENTION

The invention relates to parking space barriers and particularly to those of the type having a vehicle blocking member which can be pushed by a vehicle entering the parking space across the parking space from a blocking to an unblocking position and which incorporate resilient means returning the blocking portion to the initial blocking position when the vehicle exits from the parking space.

One advantage of parking space barriers of this type is that, the energy stored by the resilient means is derived from the entering vehicle, obviating any requirement for manual return of the barrier or for a substantial external power source to effect return automatically, reducing very substantially installation and maintenance costs.

One parking space barrier of this type is disclosed, for example, in U.S. Pat. No. 3,913,264 issued Oct. 21, 1975 to Kohen. However, such barrier requires a track defining housing at the perimeter of the parking space which must be cleared periodically of debris or ice, while the vehicle engaging portion is a horizontal arm which is therefore height sensitive to the vehicle. Furthermore, relatively accurate alignment of the vehicle with the blocking arm is necessary when entering the parking space while there is also risk of the vehicle body accidentally scraping an upright required to support the arm adjacent the entrance. It is well recognized that maneuvering into relatively tight parking spaces is a major cause of minor vehicle body damage. Additionally, the extensive structure forms a barrier or hazard to people crossing parking lots to reach their cars.

U.S. Pat. No. 3,849,936 to Geraci issued Nov. 26, 1974 discloses a ramp structure with a restoring spring depressible, when unlocked, by an entering vehicle passing thereover. However, maintenance would be required to keep the structure free of snow and debris, while visibility can also be a problem. In addition, there is a risk of persons attempting to drive their vehicles over the ramp when in the raised position.

U.S. Pat. No. 2,356,559 to Banschbach issued Aug. 22, 1944 discloses a vehicle arrestor having an impact member longitudinally reciprocal against a retarding spring specifically to arrest vehicle movement. Clearly, such impact member would never be locked in a fixed blocking position as to do so would defeat the entire purpose and the reason for using the spring which resiliently arrests the vehicle.

Other types of parking space barrier are disclosed in U.S. Pat. No. 4,941,284 issued Jul. 17, 1990 to Stoler, U.S. Pat. No. 4,901,071 issued Feb. 13, 1990 to Fletcher, U.S. Pat. No. 4,914,563 issued Apr. 24, 1990 to Stice, U.S. Pat. No. 4,879,554 issued Nov. 7, 1989 to Diaz-Silveira and U.S. Pat. No. 4,713,910 issued Dec. 22, 1987 to Quante.

It is an object of the invention to provide a parking space barrier which will obviate or ameliorate at least some of the above-mentioned disadvantages.

According to one aspect of the invention a parking space barrier comprises a base over which a vehicle can pass and means to anchor the base on the ground of the parking space in the path of a vehicle; a vehicle blocking pylon having a peripheral cushion portion upstanding from a ground contacting carriage; extensible, flexible, cable means interconnecting the pylon and the base, the cable means being extensible for movement of the pylon by the vehicle entering the space from a vehicle blocking position adjacent the base, away from the base, across the parking space to a vehicle admitting position; resilient means in one of the base and pylon operably connected to the cable means for resisting such extension and movement of the pylon away from the base; releasible locking means for locking the pylon to the base when adjacent the base, whereby, in a locked condition adjacent the base, the blocking pylon prevents a vehicle from entering the parking space and release of the locking means permits an entering vehicle to push the pylon in upright condition across the parking space in the path of the vehicle by engagement with the cushion portion causing extension of the cable against the action of the resilient means, the resiling force thereof subsequently withdrawing the cable and the pylon back across the parking space with the vehicle when reversing from the space to the locked, blocking position at the entrance to the parking space.

The provision of the linking cable obviates any requirement for a housing track and consequential extensive site construction and expensive maintenance which would be required to maintain a track free of debris, snow or ice. Minimal dexterity in vehicle alignment is required as the pylon can be pushed in any direction (within limits) because of the flexibility of the cable link. The precise height of the pylon is not critical but 3 feet is usually appropriate. Furthermore, absolutely no structure is required to be erected at the perimeter of the parking space enabling an unrestricted entrance, eliminating risk of vehicle body scrapes.

Preferably, the parking space barrier includes remote control means comprising a remote transmitter operable by the vehicle user and a receiver in the base, power supply means in the base connected to the receiver which is operable to release and engage the locking means in response to a signal from the transmitter. The locking means may include a solenoid operably connected to a latch thereof and the receiver may include a wirelessly operated switch connected between the power supply means and the solenoid to effect operation thereof to move the latch between locking and release positions.

This arrangement enables the car driver to operate the parking space barrier without leaving the vehicle. Furthermore, the wirelessly operated switch, solenoid and controller may all be commercially available units simplifying construction and reducing costs.

The pylon may include a housing frame and a cable drum rotatably mounted on the housing frame and incorporating therein a constant velocity spring motor whereby movement of the pylon away from the base rotates the drum, unwinding cable therefrom and winds up the spring motor, so that release of the pylon will cause the spring motor to rotate the drum in an opposite sense winding in the cable and drawing the pylon towards the base.

Preferably, the pylon includes visual indicating means operably connected to the locking means for indicating whether the locking means is in a released or engaged condition. The visual indicating means may include a stationary indicator housing mounted at the top of the pylon and having a window facing the direction of the base; an upstanding rotary shaft carrying an indicating member on the top thereof mounted in the indicator housing, the indicating member having portions marked to indicate a released and locked condition of the locking means, respectively, and, means operable in response to a change in the condition of the locking means for rotating the shaft thereby moving the indicator across the window to expose the released and locked portions therein, alternatively.

As the indicator is mounted on the top of the pylon it may be seen by the driver in all positions of the vehicle. An auxiliary indicating means, mounted for example on a post at the perimeter of the parking space, is therefore not required.

Desirably, the rotary shaft is mounted concentrically on the drum, the shaft rotating means comprises a pair of orthogonally extending racks operatively linked together by a double pinion, a further pinion carried by the shaft operatively connected to one rack and the other rack being aligned for reciprocation by the solenoid.

This provides an extremely simple and reliable actuating mechanism which may be substantially maintenance free.

More particularly, the parking space barrier locking means may include a pair of orthogonally extending racks linked together by a double pinion, the latch being carried by one rack and the other rack being connected to the solenoid core.

This further simplifies the construction and minimizes maintenance of the parking space barrier.

Arresting means may be provided on the pylon with actuating means to raise and lower the arresting means between inoperative and ground engaging conditions, in which the pylon is free for withdrawal across the parking space by the resilient means and prevented from such withdrawal, respectively.

The arresting means may comprise elongate members of soft, resilient material eccentrically mounted on opposite sides of the carriage for pivotal movement about a longitudinal axis between the raised and lowered positions and the actuating means may comprise a pedal crank operatively connected to each member to effect pivotal movement thereof.

Rolling means such as balls or castors or a skid of solid lubricant may be provided on the carriage to facilitate movement thereof across the parking space, the elongate members being pivotal between inoperative positions above, and ground engaging positions below the rolling means or skid, respectively.

BRIEF DESCRIPTION OF THE DRAWINGS

A specific embodiment of a parking space barrier according to the invention will now be described by way of example only and with reference to the accompanying drawings in which.

DESCRIPTION OF THE PREFERRED EMBODIMENT

The parking space barrier 11 comprises a stationary base member 12 and a moveable pylon 13 interconnected by an extensible cable 15.

Figure 1:
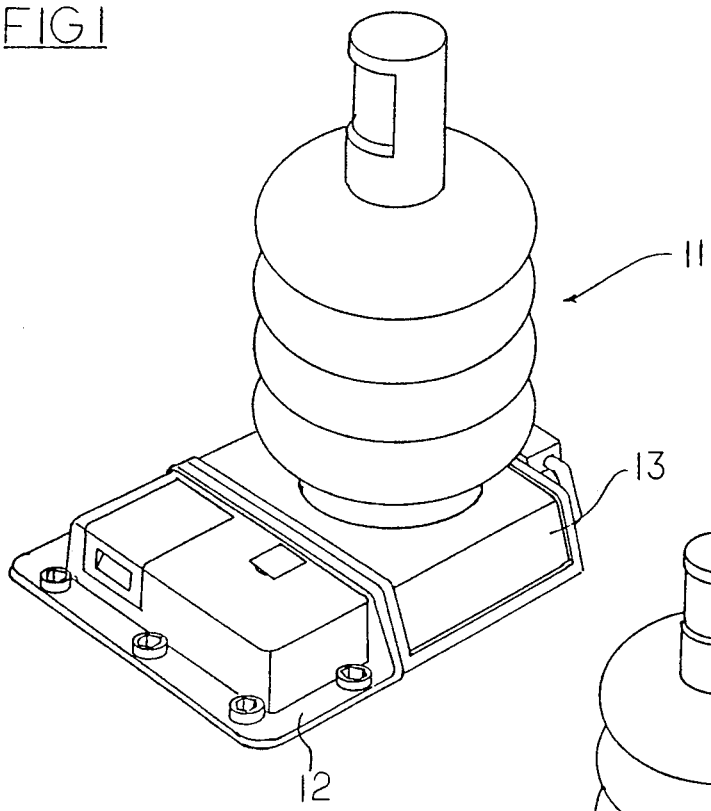
FIG. 1 is a front, perspective view of the parking space barrier with the pylon and base member thereof locked together in a vehicle blocking condition.
Figure 2:
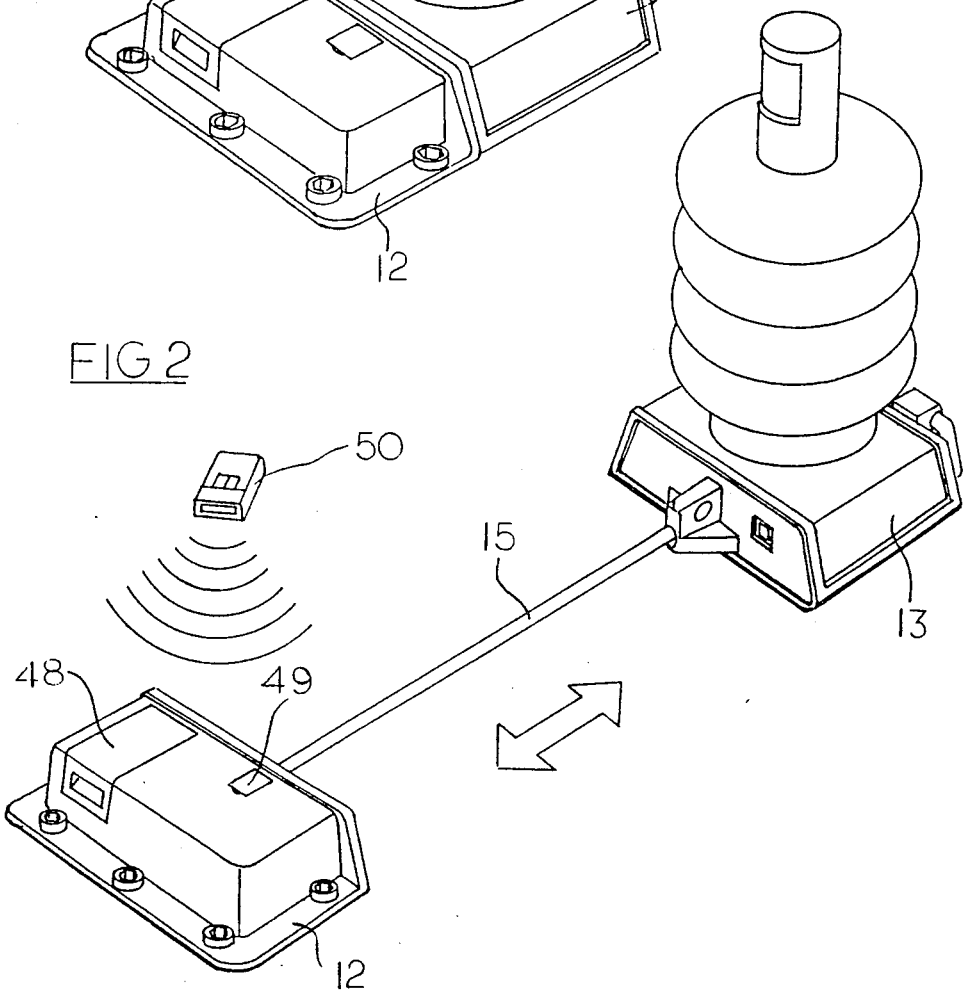
FIG. 2 is a perspective view of the parking space barrier with the pylon released and moved apart from the base member.
Figure 3:
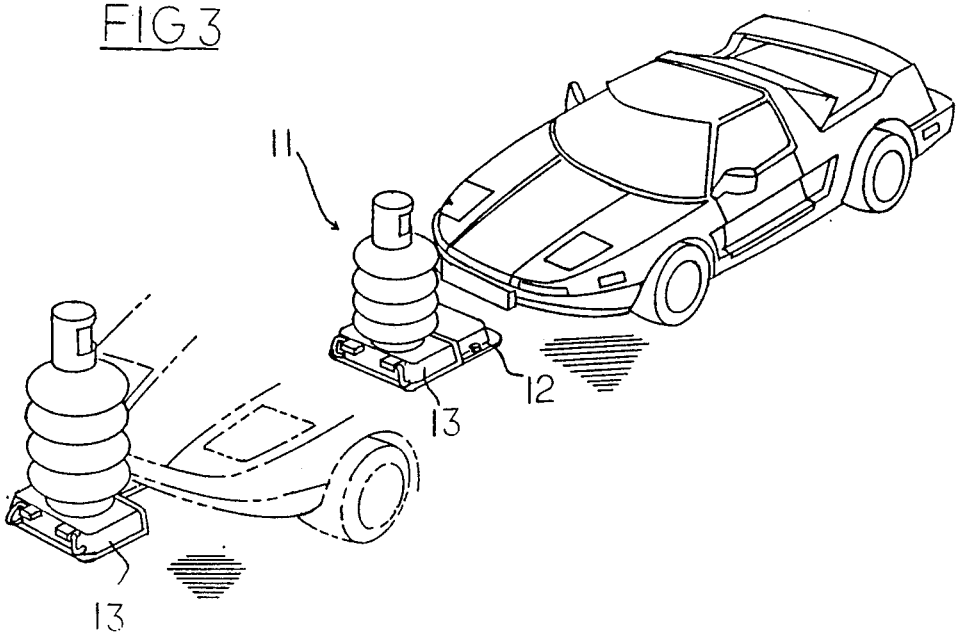
FIG. 3 is a rear perspective view of the parking space barrier locked in a vehicle blocking position and released with the vehicle pushing the pylon away from the base member, across a parking space during entry therein.
Figure 4:
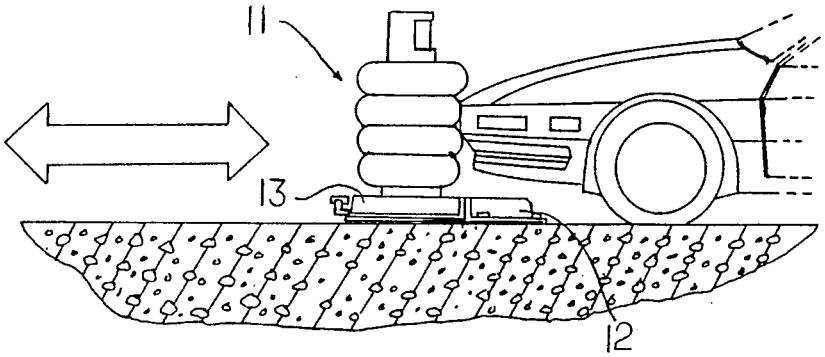
FIG. 4 is an elevational view of the parking space barrier at the time of initial engagement with a vehicle entering the parking space.
Figure 5:
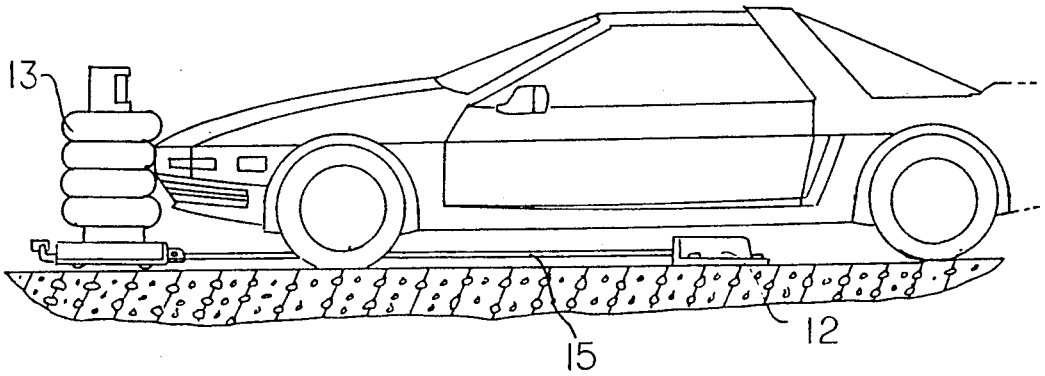
FIG. 5 is a similar view to FIG. 4 after the vehicle has entered the parking space.
Figure 6:
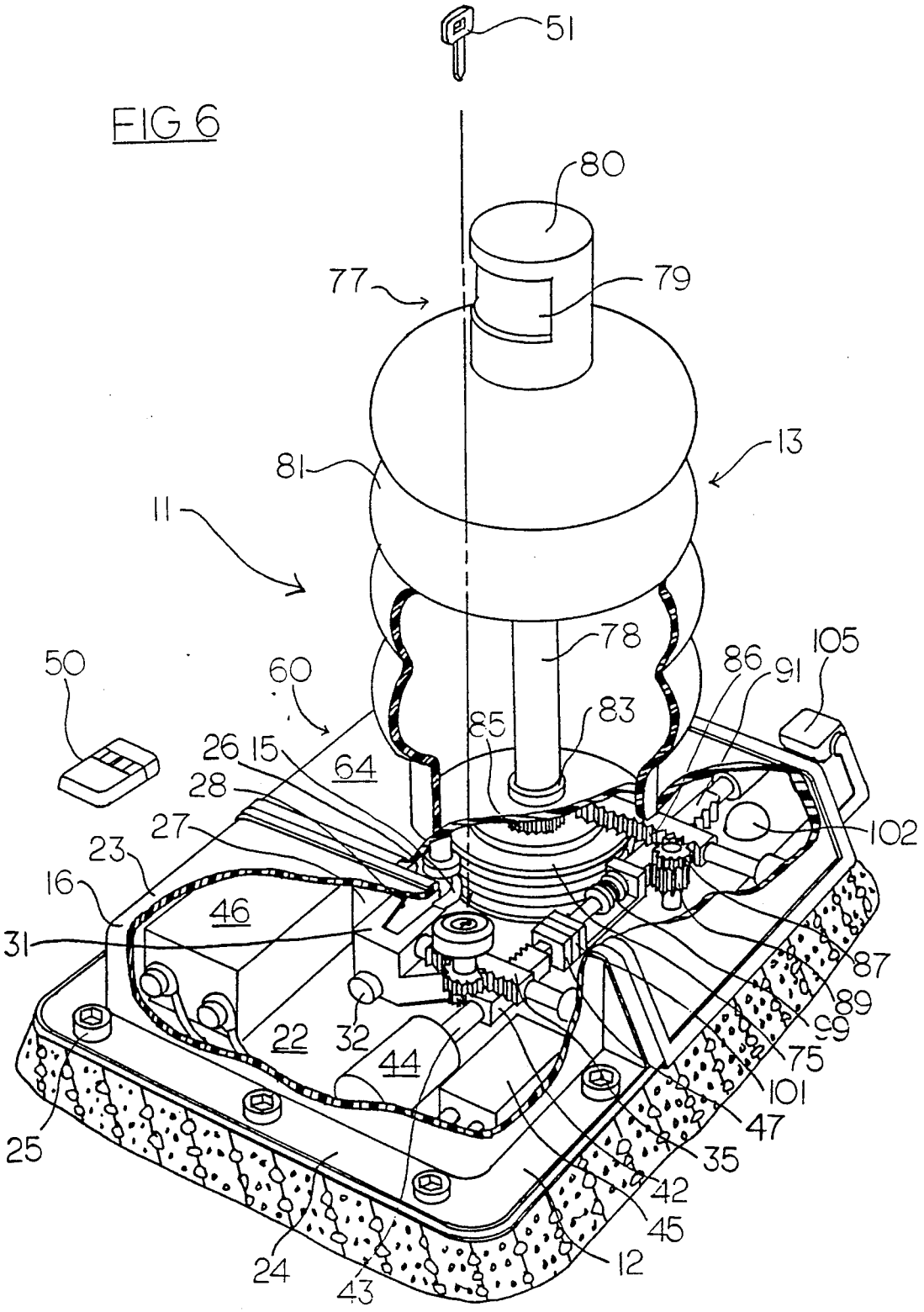
FIG. 6 is a perspective view, partly cut away, of the parking space barrier in the vehicle blocking condition in which the locking mechanism is engaged and locked.

As best seen in FIG. 6, the base member 12 comprises an outer housing casing 16 of rigid reinforced plastic comprising a flat, bottom wall 22 and a rectanguloid, domed upper wall portion 23 attached thereto in watertight fashion, as by adhesive. An anchoring flange 24 extends outwardly from three sides of the casing and receives anchoring bolts 25 at intervals for anchoring the base to the floor of the parking space which may, for example, be made of concrete. The fourth side 26 of the casing forms a mating face which is sealed by a wall portion 27 except at a female cavity 28 of a locking mechanism 29 described below and an aperture (not shown) for an indicating mechanism abutment 47, also described below.

The locking mechanism 29 comprises a frame part 31 (of known type) attached to the wall portion 27 and extending inwardly therefrom defining a female cavity or clevis having a cable anchoring portion 32 at an inner, blind end of the clevis.

Latching apertures 33, 33' are formed in axial alignment in opposite wall portions of the clevis for sliding receipt of a bolt 34 in the engaged condition of the locking mechanism. The bolt 34 is carried at one end of a rack 35 mounted for axial reciprocation at the opposite end in a sleeve bearing 36 attached to a side wall of the upper casing part, the aperture 33 providing the other slide bearing.

The rack 35 meshes with one pinion 37 of a double pinion assembly 38 operably connected for axial (optional) rotation at an upper end by a cylinder lock 39 having an outer casing 40 mounted immovably in the upper casing part.

The lower end of the double pinion carries a second pinion 41 meshed with a rack 42 mounted on the end of a core or armature 43 of a solenoid 44. The other end of the rack carries an abutment member 47 (FIGS. 6 and 8*a*) extending through the wall 27 so as to protrude from the mating face.

The solenoid 44 is operatively connected through a wirelessly operated switch 45 to a battery power source 46. The switch 45, includes a radio (HF) receiver manufactured by Linear Electronics as a single channel digital security receiver, D-67 series, and is responsive to signals from a standard, conventional remote controller 50 also available from Linear Electronics (D-224 series).

Removable covers 48 and 49 are incorporated in the upper wall affording access to the battery 46 and a manually operable cylinder lock 39 connected to the upper end of the double pinion 38.

Figure 7:
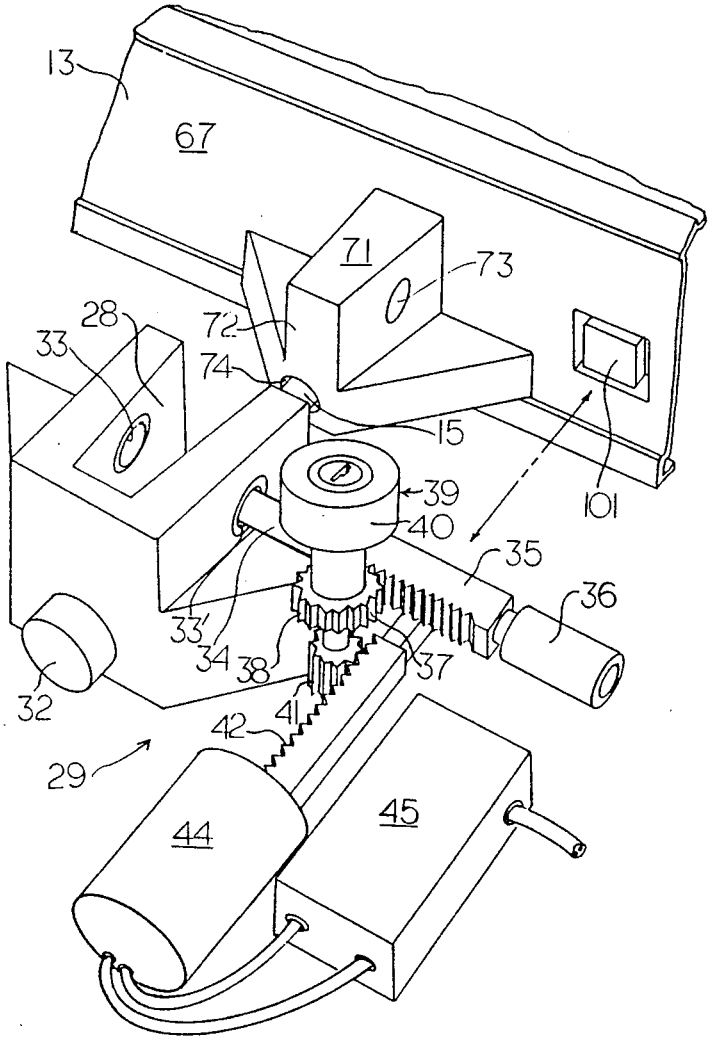
FIG. 7 is an isometric view of a portion of the parking space barrier immediately after release of the locking mechanism and fractional movement of the pylon away from the base.

It will be appreciated from a consideration of FIG. 6 and 7 that operation of the switch to energize the solenoid advances the rack 43 (and abutment 47) rotating the pinions 37/41 in a counter clockwise direction to move the rack 35 in a leftwards direction sliding the bolt across the clevis into the aperture 33' to place the locking mechanism in an engaged condition shown in FIG. 6. Subsequent operation of the switch causes the withdrawal of the armature by the solenoid rotating the pinions clockwise to withdraw the bolt from the clevis into the release position. Operation of the bolt can also be effected manually by actuation of the cylinder lock 39 using the key 51.

Figure 10:
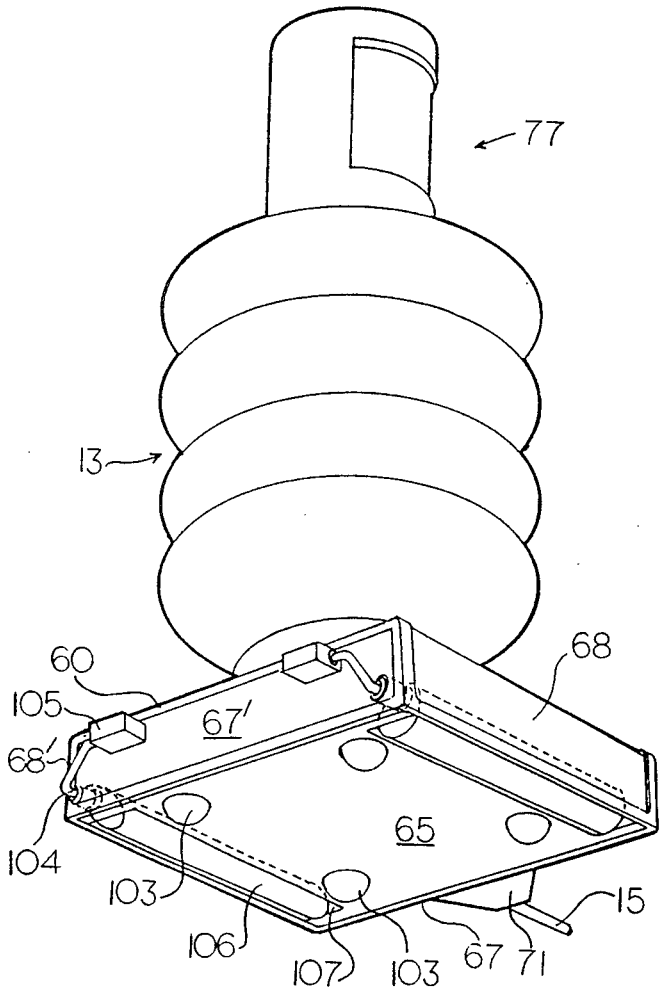

The pylon 13 includes a carriage 60 which comprises a rectanguloid, dome-like casing shell having upper and lower walls 64, 65 and opposed side walls 67, 67' and 68, 68' (FIGS. 6 and 10). A front side wall 67 (FIG. 7) has a male mating locking member 71 of (known) complementary profile to the female member of the base, extending therefrom having an upstanding land 72 formed with a bolt receiving aperture 73 extending transversely therethrough and a longitudinally extending cable receiving bore 74.

Figure 8A:
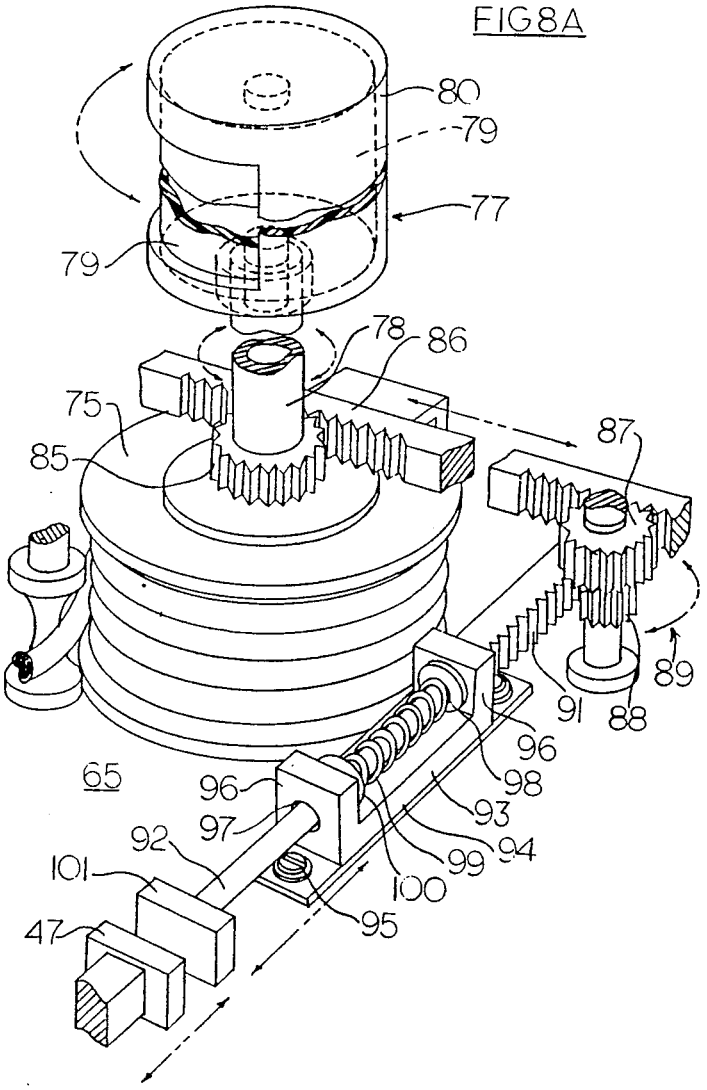
FIG. 8*a* is an isometric view of a locking condition indicating mechanism of the parking space barrier.
Figure 8B:
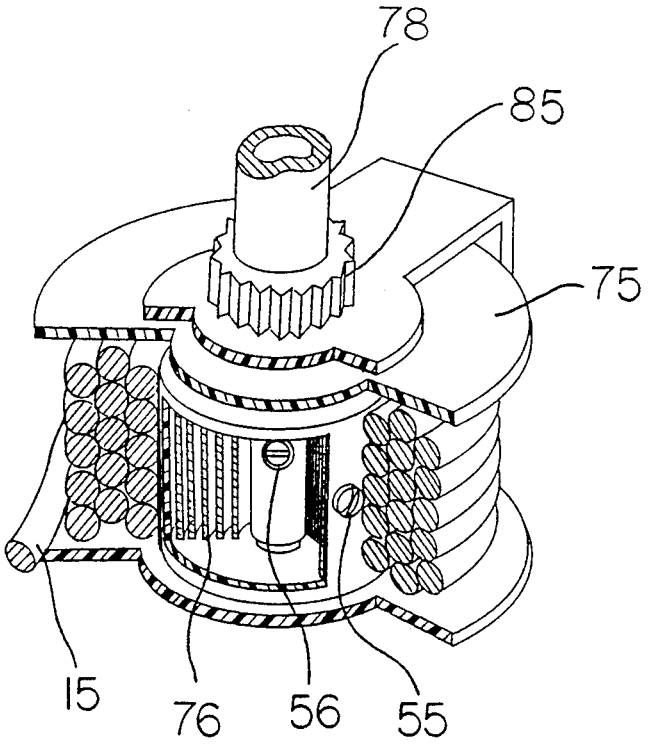
FIG. 8*b* fragmentary view partly in cross-section of the cable winding drum shown in FIG. 8*a;*

As shown in FIGS. 6, 8*a* and 8*b*, a cable winding drum 75 is mounted on the lower wall 65 of the casing for rotation about a vertical axis and the cable extends from an end anchored in the base through the bore 74 around the drum 75.

A coil spring 76 is housed within the drum and has opposite ends connected to the rotary drum and to the casing, at 55 and 56, respectively, to be wound up when the drum is rotated paying out the cable.

Figure 9:
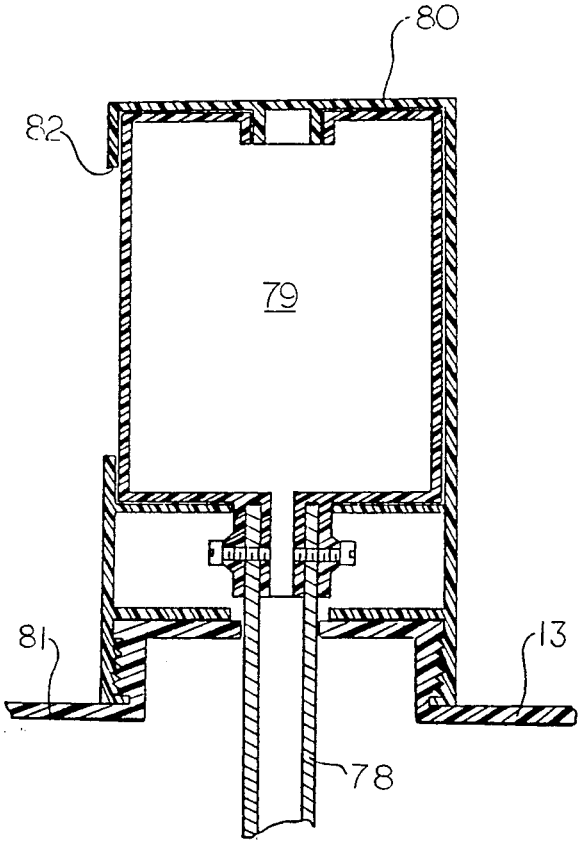
FIG. 9 is a cross-sectional view of a portion of the indicating means, shown in FIG. 8; and, FIG. 10 is an isometric view of the underside of the pylon of the parking space barrier.

As shown in FIGS. 6, 8 and 9, an indicating mechanism 77 showing the condition of the locking mechanism includes a post 78 mounted to upstand from an upper surface of the drum 75 and carrying at an upper end thereof, a cylindrical sign 79 having its cylindrical surface divided into sectors marked in red and green indicate engaged and released conditions of the locking mechanism.

The sign is mounted for reciprocal rotation in an outer housing 80 threaded onto a coupling formed on an upper axial end of a resiliently flexible tubular cushion or buffer 81 affixed, surrounding the post concentrically, on the upper wall 64 of the carriage casing. The housing 80 is formed with a window 82 facing towards the base, past which window the colored sectors are rotated during a change in the condition of the locking mechanism. The post is rotatably mounted in a bearing 83 in the upper wall of the housing and carries a pinion 85 at a lower end which is meshed with a rack 86 having opposite ends housed in sleeve bearings mounted on opposite housing side walls. The rack 86 meshes with an upper pinion 87 of a double pinion wheel 88 rotatably mounted on upper and lower walls of the housing and having a second pinion 89 meshed with a rack 91 extending orthogonally of the rack 86 towards the mating face. The rack 91 has an extended rod portion 92 on a forward end having an abutment member 101 at a free end thereof. A U-form frame 93 has a base 94 screw fastened at 95, to the lower wall and has arms 95 forward with bearing apertures 97 and 98, respectively, slidably receiving the rod portion 92. A compression spring 99 is located on the rod portion 92 trapped between one arm 96 and a retaining washer 100 fixedly attached to the rod portion 92. Reciprocation of the rod portion 92 moves the rack, pinion shaft and indicating cylinder in opposite directions with compression and relaxation of the spring 99, as apparent from a consideration of FIGS. 6 and 8.

As best seen in FIGS. 6 and 10, the lower wall of the carriage 60 is formed with ball cups 102 receiving respective balls 103 enabling the pylon to be rolled freely in upright condition across the flat ground of the parking space.

A frictional arresting mechanism for the pylon comprises a pair of mounting rods 104 having cranked ends carrying pedals 105 and carrying along their length respective eccentric elongate feet 106 of friction material (soft plastic or rubber). Apertures 107 are formed in the lower wall aligned below the respective feet. Depression of the pedals 105 in the direction of the arrows shown in FIG. 10 rotates the feet 106 to protrude through the respective apertures 107 below the level of the balls 103 into engagement with the ground thereby to prevent free movement of the pylon across the ground.

In operation, with the parking space barrier lock engaged as shown in FIGS. 1, 3, 4 and 6, the driver of an approaching vehicle wishing to use the parking space actuates the remote controller to transmits a radio frequency signal to the receiver of the switch 45 which operates the solenoid 44 to withdraw the abutment 47 and bolt 34, thereby releasing the pylon from the base. As the abutment 101 is withdrawn the resiling action of the compression spring 99 advances the rack 91 thereby rotating the double pinion wheel 89 and moving the rack 86 to the left to rotate the post 78 and cylindrical indicator 79, bringing the green sector into alignment with the window 82, indicating proper release of the locking mechanism.

The vehicle is then advanced into engagement with the buffer 81 of the pylon and driven into the parking space pushing the pylon before it across the ground with the cable being paid out from the rotating drum 75 which progressively winds up the coil spring motor 76. During reversal of the car out of the parking space, the stored energy of the spring motor causes the drum to maintain tension in the cable progressively winding in the cable, ensuring that the contact between the pylon and the car is maintained with the pylon being withdrawn progressively toward the base until the male locking member 71 enters the female locking member cavity 28 when the lock can be engaged either by operation of the remote controller 50 or, if desired, by operation of the key mechanism 39. As the male member enters the female member the abutments 47 and 101 are brought into engagement with compression of the compression spring 99 and movement of the rack and pinion mechanism from the position of FIG. 8 to the position of FIG. 6 to bring the red sector into the window, indicating engagement of the locking mechanism.

Solenoid 44 is manufactured by Locknetics Security Engineering, Forestville, Conn. 06010 (model 404, Ser. 47957-01) and includes a catch mechanism which maintains the armature either in the advanced on withdrawn condition and which can be over-ridden either by the manually operated locking mechanism or released by a signal received from the remote controller.

It will be apparent that the invention provides a relatively simple compact and inexpensive, remotely operated parking barrier which can be operated by the driver from within the vehicle immediately prior to entering the parking space, and can be easily seen by the driver in all positions enabling the locking condition to be verified. The device can be installed at relatively low cost particularly since underground or inground tracks or guides are obviated and does not require an external power source, as the stored energy of the spring motor is enabling return of the pylon to the locked position derived from the vehicle power.

The absence of a track obviates any requirement for clearing ice or debris therefrom providing a maintenance free construction, also obviating any requirement for inground drainage. The device fits entirely within a small area of the entrance in the parking space itself and does not obstruct the passage of people across the parking lot, nor is there a risk of people accidentally tripping over the device as the pylon is visible and soft. The provision of the resiliently flexible cover obviates any damage to the car while the car itself need not be aligned with any great precision for engagement with the pylon but can enter the parking space at any angle (within limits) as the cable enables the pylon to move across the parking space at any angle. The complete absence of rigid upstanding structures adjacent the entrance or perimeter of the parking space also obviates risk of bodywork damage otherwise likely to be caused by scraping thereagainst as a result of carelessness during parking.

It will be appreciated that, if necessary, the racks may be supported by additional guides mounted on the casing.

In a modification, the coil spring may be incorporated in a spring motor mechanism similar to that described on pages 176–7 of "Mechanisms and Mechanical Devices Sources" authored by Chinoris and published in 1991 in USA by McGraw-Hill.

Furthermore, a solar powered unit may be incorporated in place of or in addition to the battery while a source of illumination or luminous/ highly reflective or luminescent material may be incorporated in the sign to ensure optimal visibility.

I claim:

1. A parking space barrier comprising:

a base over which a vehicle can pass and means to anchor the base on the ground of the parking space in the path of a vehicle;

a vehicle blocking pylon having a peripheral cushion portion upstanding from a ground contacting carriage;

extensible, flexible, cable means interconnecting the pylon and the base, the cable means being extensible for movement of the pylon by the vehicle entering the space from a vehicle blocking position adjacent the base away from the base across the parking space to a vehicle admitting position;

resilient means in one of the base and pylon operably connected to the cable means for resisting such extension and movement of the pylon away from the base;

releasible locking means for locking the pylon to the base when adjacent the base, whereby, in a locked condition adjacent the base, the blocking pylon prevents a vehicle from entering the parking space and release of the locking means permits an entering vehicle to push the pylon in upright condition across the parking space in the path of the vehicle by engagement with the cushion portion causing extension of the cable against the action of the resilient means, the resiling force thereof subsequently withdrawing the cable and the pylon back across the parking space with the vehicle when reversing from the space to the locked, blocking position at the entrance to the parking space.

2. A parking space barrier according to claim 1 including remote control means comprising a remote transmitter operable by the vehicle user and a receiver in the base, power supply means in the base connected to the receiver which is operable to release and engage the locking means in response to a signal from the transmitter.

3. A parking space barrier according to claim 2 in which the locking means includes a solenoid having a core operably connected to a latch of the locking means and the receiver includes a wirelessly operated switch connected between the power supply means and the solenoid to effect operation thereof to move the latch between locking and release positions.

4. A parking space barrier according to claim 3 in which the locking means includes male and female elements on the pylon and base respectively, the male element being drawn into the female element by movement of the pylon to the blocking position adjacent the base under the resiling action of the biasing means.

5. A parking space barrier according to claim 4 in which the pylon includes a housing frame;

a cable drum rotatably mounted on the housing frame;

and the biasing means includes a coil spring member operably connected between the drum and the housing frame so that movement of the pylon away from the base unwinds cable from the drum, stressing the spring, the resiling action of which will rotate the drum in an opposite sense winding cable thereon and withdrawing the pylon towards the base.

6. A parking space barrier according to claim 1 in which the pylon includes visual indicating means operably connected to the locking means for indicating whether the locking means is in a released or engaged condition.

7. A parking space barrier according to claim 6 in which the visual indicating means includes a stationary indicator housing mounted at the top of the pylon and having a window facing the direction of the base;

an upstanding rotary shaft carrying an indicating member on the top thereof mounted in the indicator housing, the indicating member having portions marked to indicate a released and locked condition of the locking means, respectively, and;

means operable in response to a change in the condition of the locking means for rotating the shaft thereby moving the indicator across the window to expose the released and locked portions therein, alternatively.

8. A parking space barrier according to claim 7 in which the rotary shaft is mounted concentrically with the drum, the shaft rotating means comprises a pair of orthogonally extending racks operatively linked together by a double pinion, a further pinion carried by the shaft operatively connected to one rack and the other rack being aligned for operative movement in one direction by the solenoid and resilient means biassing the rotary shaft in one rotary direction corresponding to the released condition of the locking means and arranged to be stressed in response to the movent of the rack by the solenoid.

9. A parking space barrier according to claim 8 in which means are provided in the pylon biasing the indicating means to indicate a released condition of the locking means which biasing means are over-rideable by movement of the solenoid to engage the locking means when the pylon is adjacent the base.

10. A parking space barrier according to claim 7 in which the locking means includes a pair of orthogonally extending racks linked together by a double pinion, the latch being carried by one rack and the other rack being connected to the solenoid.

11. A parking space barrier according to claim 1 in which arresting means are provided on the pylon and actuating means are provided to raise and lower the arresting means between inoperative and ground engaging conditions, in which the pylon is free for withdrawal across the parking space by the resilient means and prevented from such withdrawal, respectively.

12. A parking space barrier according to claim 11 in which the arresting means comprises elongate members of soft, resilient material eccentrically mounted on opposite sides of the carriage for pivotal movement about a longitudinal axis between the raised and lowered positions and the actuating means comprises a pedal crank operatively connected to each member to effect pivotal movement thereof.

13. A parking space barrier according to claim 12 in which rolling means are provided on the carriage to facilitate movement thereof across the parking space, the elongate members being pivotal between inoperative positions above, and ground engaging positions below, the rolling means, respectively.

14. A vehicle parking space barrier of the type comprising a stationary base and a movable vehicle blocking member, means releasibly locking the blocking member to the base in a vehicle blocking position adjacent the base, extensible means linking the blocking member to the base for movement to an unblocking position by engagement with a vehicle entering the parking space, resilient means connected between the linking means and between one of the base and blocking member and stressed by movement of the blocking member to the unblocking position so that energy stored thereby can withdraw the blocking member toward the base, the improvement residing in that the base is of low height and adapted for anchoring in the parking space, the blocking member is a pylon engageable by the front of the vehicle and the linking means comprises a flexible cable so that the entering vehicle can engage and push the pylon in upright condition across the parking space causing progressive extension of the cable which stresses the resilient means while the vehicle passes over the base and cable.

* * * * *